United States Patent [19]

Nivelleau de La Bruniere et al.

[11] Patent Number: 4,790,905

[45] Date of Patent: Dec. 13, 1988

[54] PROCESS FOR THE PULPING OF LIGNOCELLULOSE MATERIALS WITH ALKALI OR ALKALINE EARTH METAL HYDROXIDE OR SALT AND A SOLVENT

[75] Inventors: Patrick M. F. Nivelleau de La Bruniere; Jean P. M. Galichon, both of Paris, France

[73] Assignee: Societe Tag Pulp Industries S.A., Liechtenstein

[21] Appl. No.: 918,612

[22] Filed: Oct. 10, 1986

Related U.S. Application Data

[63] Continuation of Ser. No. 706,156, Feb. 27, 1988, abandoned.

[51] Int. Cl.[4] ..... D21C 3/02; D21C 3/20

[52] U.S. Cl. ..... 162/56; 162/72; 162/77; 162/90

[58] Field of Search ..... 162/63, 56, 19, 18, 162/77, 72, 90

[56] References Cited

U.S. PATENT DOCUMENTS

| | | | |
|---|---|---|---|
| 2,218,479 | 10/1940 | Peterson et al. | 162/72 |
| 3,255,071 | 6/1966 | Kleinert | 162/63 |
| 3,664,918 | 5/1972 | Clayton | 162/19 |
| 4,091,749 | 5/1978 | Procter et al. | 162/72 |
| 4,248,663 | 2/1981 | Kubes | 162/72 |
| 4,552,616 | 11/1985 | Kauppi | 162/72 |

FOREIGN PATENT DOCUMENTS

| | | | |
|---|---|---|---|
| 0010451 | 4/1980 | European Pat. Off. | 162/72 |

OTHER PUBLICATIONS

Rydhulm, "Pulping Processes", Interscience Publishers, N. Y., 1969, p. 336.

*Primary Examiner*—Steve Alvo

*Attorney, Agent, or Firm*—Ostrolenk, Faber, Gerb & Soffen

[57] ABSTRACT

A process for preparing a cellulose paste by treatment of lignocellulose materials which comprises impregnating wood or vegetable shavings in divided form with an aqueous solution containing 2 to 20% by weight of alkaline metal hydroxides, alkali metal salts, or alkaline earth metal hydroxides, adjusting the weight of the solution retained by impregnation to a value representing 1 to 3 times the weight of treated material, the ratio of the weight of the impregnated mass to the dry weight of the lignocellulosic material being preferably not more than about 2.6:1, subjecting the impregnated masses to cooking treatment by exclusively indirect heating at a temperature varying from 150° to 200° C. without exerting any mechanical disintegrating action for a period varying from 15 to 60 minutes, and pressing the cooked product so as to extract therefrom the solubilized lignin in the form of a black liquor containing about 50% of dry material. When operating at atmospheric pressure, the aqueous solution may further contain from 2 to 20% by weight of solvent chosen from the group comprising glycols, alkanolamines, sulfoxides and fatty acid salts.

5 Claims, No Drawings

PROCESS FOR THE PULPING OF LIGNOCELLULOSE MATERIALS WITH ALKALI OR ALKALINE EARTH METAL HYDROXIDE OR SALT AND A SOLVENT

This is a continuation of application Ser. No. 706,156 filed Feb. 27, 1985 and now abandoned.

BACKGROUND OF THE INVENTION

In traditional processes used today in industry, wood is treated by chemical aqueous solutions such as alkaline or alkaline earth salts of sulphydric acid or sulphurous acid.

These techniques have the following disadvantages; duration of cooking of several hours, up to ten hours, Considerable dilution of the aqueous solutions which represent 5 to 10 times the weight of wood used, whence the necessity to have a considerable volume of water available and to use a great amount of energy for heating to the cooking temperature.

The black liquid subproduct must be evaporated so as to reach a concentration of the order of 50% of dry matter, allowing combustion and chemical products to be recovered, whence a considerable energy consumption considering the mass of water used.

High investment costs due to the volumes and the service pressure of the reactors.

Pollution of the atmosphere by gaseous sulphurated subproducts (dimethylsulfide, methylmercaptan).

Pollution of the waters by liquid cooking waste.

Other processes which have not reached the industrial level consist in treating the wood by solvents of the alcohol, amine, aminoalcohol, sulfoxide type in an acid medium or in the presence of alkaline or earth alkaline bases.

These processes while have certain advantages with respect to the traditional processes such as a higher cooking rate (30 minutes to 3 hours) and absence of pollution, are however difficult to justify economically, because of the excessively high consumption of the solvent used and the price thereof.

This consumption is itself relates partly to the volume of solvent used (2 to 6 times the weight of the wood).

An improvement for reducing the consumption of solvent consists in treating the wood shavings in a twin-screw mixing extruder with a minimum of solvent and caustic soda for example, so as to obtain a pasty consistence.

In this improved process, although the loss of solvent is reduced it is however not neglible and the equipment to be used must be specially tuned so as to avoid in particular a premature cellulose fiber-black liquid separation in the body of the extruder, which would lead to blockages.

The process of the invention allows most of the above-mentioned disadvantages to be avoided by cooking the wood shavings at atmospheric pressure or at a very low pressure in the solid phase after impregnation with a chemical reactant.

SUMMARY OF THE INVENTION

The process for preparing a cellulose paste by treatment of lignocellulose materials in accordance with the invention involves impregnating the wood or vegetable shavings in divided form with an aqueous solution containing 2 to 20% by weight of alkali or alkaline earth salts or hydroxides, adjusting the weight of the solution retained by impregnation to a value representing 1 to 3 times the weight of treated material, the ratio of the weight of the impregnated mass to the dry weight of the lignocellulose material being preferably not more than about 2.6:1, subjecting the masses impregnated by cooking treatment by exclusively indirect heating at a temperature varying from 150° to 200° C. without exerting any mechanical disintegrating action for a period varying from 15 to 60 minutes and in pressing the cooked product so as to extract therefrom the solubilized lignin in the form of a black liquor containing about 50% of dry material.

When operating at atmospheric pressure, the aqueous solution may further contain from 2 to 20% by weight of solvent chosen from the group comprising glycols, diols, alkanolamines, sulfoxides and fatty acid salts.

The cooking treatment may also be carried out in an autoclave at a pressure of 3 to 8 bars.

The weight of solution retained during impregnation may be brought to a value between 1 and 3 times the weight of the material treated by following the impregnation by draining and drying in a tunnel oven, before subjecting the impregnated material to the cooking treatment.

In the case of treating light and divided lignocellulose materials, such as straw, bagasse and alfa, the impregnation is followed by the pressing so as to bring the weight of solution obtained to a value between 1 and 1.5 times the weight of the treated materials.

The impregnation is preferably carried out at a temperature of the order of 100° C.

In a preferred embodiment, the salt and/or solvent content of the impregnation solution is adjusted to a value such that the melting point of the alkali or alkaline earth compounds remaining in the mass after evaporation of water during impregnation or during drying of the impregnated mass is between 150° and 200° C.

The cooked product is subjected to mechanical disintegration in the presence of a small amount of water and pressed so as to extract a black liquor containing about 50% dry material.

Solid phase cooking is the essential characteristic of the invention. It allows:

only a small amount of water to be used: 1 to 3 times the weight of the wood.

A black liquor to be collected having a high dry material concentration and so directly combustible.

Atmospheric pollution by sulfurated derivatives to be avoided, since the chemical reactants used do not contain any sulphur.

The consequences of these characteristics of the invention are:

a reduced investment cost by using less bulky apparatus for the some production, a reduction in the size of the apparatus for concentrating the black liquor, suppression of anti pollution equipment.

A lesser energy consumption relates to the considerable reduction of the mass of water to be heated or evaporated.

Two cases are to be considered depending on whether the cooking takes place at atmospheric pressure or at a pressure of a few kilograms/cm$^2$.

FIRST CASE

At atmospheric pressure, it is preferable to add to the liquor for impregnating the shavings with a small amount of a solvent with high boiling point (>150° C.) or a fatty acid salt or any other chemical product for lowering to 150°-200° C., more particularly, 150°-180° the melting temperature of the alkali or alkaline earth reactants used.

In this case the process comprises the following phases:

1. Impregnation

It is particularly important for the success of the following phases.

The impregnating liquid is water to which is added a solvent of the glycol, diol, ethanolamine, etc type in an amount of 2 to 20%: alkali chemical reactants of the soda carbonide, soda, sodium sulphide or sodium polysulphide, etc type or alkalines earth soluble in water in an amount from 2 to 20%.

This impregnation preferably takes place at a temperature close to 100° C., so as to ensure that the impregnation liquor penetrates to the core.

A more thorough mechanical division of the wood also improves the impregnation.

2. Draining and Drying

The impregnated shavings are drained, then the solid mass is introduced into an oven where it moves by gravity, or by a mechanical means (for example, under a thickness of a few centimeters on a metal belt moving inside the oven).

The water vapor, possibly with small amounts of solvent, which is released from the impregnated wood mass, is recycled to the impregnation phase.

The latent heat is recovered.

3. Reaction

The wood shavings still containing solvent in a small amount and the chemical reagents, are then heated to 150°-190° C., at atmospheric pressure for a variable time (15 to 30 minutes, for example).

The solvent which is released is recovered and recycled.

During this solid phase treatment, the lignin reacts with the alkaline reactants.

4. Cellulose fiber-black liquor separation

The shavings leaving the oven have added thereto a minimum amount of water so as to obtain a paste.

This is made possible by the fact that the lignin has been transformed into a water soluble product during the preceding treatment, which makes shredding of the wood easy without an intensive mechanical action.

This paste is pressed in a conventional apparatus of the screw press type.

The advantage of adding the minimum amount of water is to obtain a concentrated black liquid easier to bring to the dry condition or which may be directly burned so as to recover the alkaline reactants.

Complete extraction of the solubilized lignin using water is obtained by successive pressing operations preferably recycling the extracted liquor each time to the preceding extraction stage.

Then, the washed cellulose paste is treated in accordance with conventional purifying and bleaching processes.

With respect to a conventional process, the advantages which may be expected from such a process are:

savings in energy.

In fact, the amount of water used is small and recovery of the latent heat from the water vapor is easy in the phase for drying the wood after impregnation.

Another important element is the elimination of the phase for concentrating the black liquid.

Lower investment costs.

The main items are:

the phase for treating the wood or the volume of equipment is reduced because of solid phase treatment and because of the shorter reaction time.

Elimination of equipment for concentrating the black liquid.

considerable reduction of pollution, by suppressing the residual reaction water since the chemical treatment place in the solid phase, by controlling the gas effluents when passing through the reaction oven.

With respect to the solvent phase processes, the advantage is the small amount of solvent used which eliminates losses.

By way of indication, the solvent to wood ratio is about 1/10 of that of a solvent phase process (Patent of 2 Apr. 1973 of S.P.E.I.P.B. at Geneva)

EXAMPLES

Among the numerous salt, base and solvent mixtures which may be used for implementing the reaction, those described below will be preferably chosen.

| | |
|---|---|
| Diethanolamine | P.E. 268° C. |
| Monoethanolamine | P.E. 172° C. |
| Glycol | P.E. 197° C. |
| Propylene glycol | P.E. 189° C. |
| butylene glycol | P.E. 192° C. |
| Sulphur | P.E. 112° C. |
| NaOH | |
| KOH | |
| $Ca(OH)_2$ | |
| Na and K sulphides and polysulphides | |
| Na and K carbonates | |
| Na and K salts | |
| N and K salts of fatty acids such as stearic, oleic, etc. | |

EXAMPLE 1

An aqueous solution is formed with

| | |
|---|---|
| water | 900 g |
| glycol | 100 g |
| sodium hydroxide | 100 g |
| 200 g of wood shavings (reckoned as dry weight) i.e. | 260 g raw, |

are introduced into the solution.

The whole is evacuated 3 or 4 times and heated to about 100° C.

After cooling, the impregnated shavings are drained.

After draining, the weight is 915 g.

The wood has therefore absorbed 655 g of solution.

The mass of impregnated shavings is then heated in an oven to a temperature of 180° C. for 45 minutes.

During the first 20 minutes, about 280 g of water are collected containing a small amount of glycol.

After 45 minutes and at the same temperature, the oven is partially evacuated and 110 g of liquid are collected containing about 50% glycol.

The vacuum is broken and the mass of hot shavings is fed into a receptacle with arm stirrer containing 100 g of water.

A paste is obtained from which can be extracted by pressing when hot a thick black liquor, about 120 g, containing about 50% dry matter.

The remaining paste is treated 3 times according to the same technique while extracting each time a less concentrated black liquor.

In an industrial process, the successive filtrates could be recycled to the preceding washing stage so as to obtain finally only a concentrated black liquor.

After the last filtering and drying operations, 120 g of a paste with 10% water are obtained, i.e. 108 g reckoned as dry matter.

The black liquor may be incinerated and leaves a soda carbonate residue.

EXAMPLE 2

A solution is formed containing

| | |
|---|---|
| water | 900 g |
| soda | 100 g |
| Sodium sulphide | 100 g (reckoned as $Na_2S$) |

The successive operations are the same as in Example 1.

However, during the passage through the oven, a slight release of sulphurated products is observed.

These may be incinerated and absorbed in a soda or soda carbonate solution.

Finally 115 g of cellulose paste with 10% water are recovered.

The incinerated black liquor leaves a sodium carbonate and sulphide residue.

SECOND CASE

Under slight pressure.

In this case, during the impregnation stage, it is possible to work with aqueous solutions of alkali or alkaline earth salts in the absence of heavy solvents.

However, under these conditions, it has been discovered that cooking at 150°–190° C. is preferably carried out in a closed reactor where outside heating then develops an internal pressure of about 3 to 8 kg/cm$^2$.

The preferred apparatus according to the invention for carrying out the cooking consists in a metal cylinder in which the impregnated and drained shavings are introduced.

The cylinder is closed and the heating carried out from the outside, while the horizontally placed cylinder rotates about its axis.

This process is fundamentally different from the one used in vertical cookers of the Escher-Wyss type for example where the preimpregnated shavings are heated by directly supplying vapor inside the reactor, which results in diluting the reaction mass which, after cooking, then has a consistency similar to molasses.

In the process of the invention, after cooking in the above described cylinder, these shavings have kept a solid appearance, but have lost any mechnical solidity.

The subsequent treatment phase characteristic of the invention consists in rapid crushing requiring a low mechanical energy which transforms the cooked shavings into elementary fibers.

These fibers are then pressed after possibly adding a minimum amount of water so as to extract a concentrated black liquor therefrom (see Pat. No. 8303415).

In the following examples, we also show that a small amount of heavy solvent may be used with the surprising result of improving the properties of the cellulose paste obtained.

EXAMPLES 1. 230.3 g of poplar wood reckoned as dry material, in the form of shavings, are introduced into a solution containing 10% NaOH. They are kept therein for 4 hours at 80° C.

The shavings are drained on a strainer and weighed. The weight is 632 g, i.e. 401.7 g of solution was retained.

These shavings are introduced into a cylinder which they fill almost completely. After closing, the cylinder is rotated in an enclosure heated to 170° C. for 1 hour 30 minutes.

2. Same operation as for 1, but using a 10% NaOH, 10% glycol solution.

| | Ex. 1 | Ex. 2 |
|---|---|---|
| % glycol in solution | 0 | 10 |
| % NaOH in solution | 10 | 10 |
| Duration at 80° C. | 4 H | 4 H |
| % NaOH introduced/dry wood | 45.8 | 45.8 |
| Weight of impregnated wood | 632 g | 630 g |
| Heating at 170° C. | 1 H 30 | 1 H 30 |
| Net yield % | 46.3 | 47.86 |
| % uncooked material | 0.04 | 0.03 |
| Permanganate Index | 13.2 | 12.4 |
| Photovolt whiteness | 40.5 | 43 |

It can be seen that the presence of glycol causes:
an improvement in whiteness,
a higher yield,
a better delignified paste.

EXAMPLES FROM PICEA SHAVINGS

Method of procedure:

193 g of shavings reckoned as dry material are introduced into a solution containing soda and possibly glycol. Impregnation takes place at 95° C. for different times.

The shavings are drained and introduced into an externally heated steel cylinder.

Heating time at 170° C.: 1 hour

After cooking, the shavings are finally crushed and the resulting paste is pressed, which gives a concentrated black liquor.

The remaining paste is treated with water, again pressed and refined.

The following table sums up the results obtained.

| Time: | 4 H | 4 H | 4 H | 4 H |
|---|---|---|---|---|
| % NaOH: | 10 | 12.5 | 10 | 12.5 |
| % glycol: | 10 | 10 | 0 | 0 |
| weight of wood impregnated | 456 | 461 | 464.5 | 475.5 |
| % NaOH retained with respect to the wood | 22.6 | 25 | 20.5 | 23.5 |
| | Cooking: 1 H at 170° C. | | | |
| Overall yield | 52.41 | 47.01 | 48.51 | 45.19 |
| Net yield | 52.39 | 46.99 | 48.50 | 45.16 |
| % uncooked | 0.02 | 0.02 | 0.01 | 0.03 |
| Permanganate index | 32.6 | 26 | 33.9 | 27.8 |
| Photovolt whiteness | 32 | 32.5 | 30 | 34 |
| Time | 3 H | 3 H | 3 H | 3 H |
| | Impregnation at 95° C. | | | |
| % NaOH | 10 | 12.5 | 10 | 12.5 |
| % glycol | 10 | 10 | 0 | 0 |
| weight of the impregnated wood | 447 | 461 | 465 | 467 |
| % NaOH retained with respect to the wood | 19.2 | 21 | 19.9 | 23.9 |
| | Cooking: 1 H at 170° C. | | | |
| Overall yield | 51.75 | 46.3 | 51.02 | 46.04 |
| Net yield | 50.89 | 46.28 | 50.61 | 46.01 |
| % uncooked | 0.86 | 0.05 | 0.41 | 0.03 |

-continued

| | | | | |
|---|---|---|---|---|
| Permanganate index | 33 | 25.4 | 34 | 25.5 |
| Photovolt whiteness | 31 | 35.5 | 30 | 32.5 |

As in the examples concerning poplar, it was discovered that the presence of glycol improves:

the permanganate index the whiteness the yield.

The same process also allowed a half chemical paste to be obtained.

EXAMPLE 230.3 g of poplar wood reckoned as dry matter are treated with the same operating procedure as before but under the conditions given in the table below:

| | | | |
|---|---|---|---|
| Impregnation at 50° C. | | | |
| % glycol | 6 | 6 | 0 |
| % NaOH | 6 | 6 | 6 |
| Time | 1 H | 2 H | 4 H |
| weight of wood impregnated | 551 | 575 | 603 |
| % of soda retained/ dry wood | 11.3 | 14.3 | 14.6 |
| Cooking at 170° C. | | | |
| Time | 1 H 30 | 1 H 30 | 1 H 30 |
| Overall yield | 67.2 | 60.4 | 54.7 |
| Net yield | | 59.84 | 51.11 |
| % uncooked material | | 0.58 | 3.64 |
| Permanganate index | 61.8 | 36.4 | 28 |
| Photovolt whiteness | 16.5 | 22 | 27.5 |

Another characteristic of the process is that other lignocellulose materials may be used;

In this case, it was discovered that when working with very light and divided lignocellulose materials, other than wood, such as: bagasse, straw, alfa, etc., this list not being limitative, the impregnation of these materials leads to a retention of a considerable liquid mass of the order of 5 to 10 times their dry weight.

This would lead to the loss of one of the advantages ot this technology, the saving in water and so in energy, since this water will subsequently be vaporized.

This difficulty may be overcome.

It has in fact been discovered that the procedure can be as follows:

1. Impregnation
2. Pressing
3. Cooking

During the impregnation stage, in this case, more dilute chemical solutions must be used.

The pressing carried out with conventional screw press type means leaves a compact product with dry appearance containing from one to two times its weight in water with respect to the dry starting material used.

It has been discovered, surprisingly, that the cooking of this compact product in a horizontal cylindrical apparatus heated from the outside gives in a short time (15 minutes to 60 minutes) and at a temperature from 150° to 180° C., a perfectly delignified very homogenous paste containing little uncooked matter.

The paper obtained is of a good quality and its low coloration makes bleaching easy.

The following examples illustrate the process:

EXAMPLE NO. 1

92 g of dry bagasse from Guadeloupe are immersed in a solution containing 6% NaOH and 6% glycol at 80° C. for 1 hour.

The impregnated mass is drained. Its weight is then 848 g.

This mass is thoroughly pressed on a hand actuated screw plate.

After pressing, a compact cake, whose weight is 267 g, remains.

This is roughly divided and placed in the cooking apparatus.

The cooking is carried out at 170° C. for 30 minutes.

EXAMPLE NO. 2

Same as example no 1 but the impregnation solution contains 5% soda and 5% glycol.

EXAMPLE NO. 3

Same as for example no 2, but the impregnation temperature is 70° C.

The following table gives the results obtained:

| | Example I | Example 2 | Example 3 |
|---|---|---|---|
| Weight of dry bagasse: 92 g. | | | |
| Impregnation Temperature | 80° C. | 80° C. | 70° C. |
| Time | I H. | I H. | I H. |
| % NaOH | 6 | 5 | 5 |
| % Glycol | 6 | 5 | 5 |
| Impregnated bagasse | 848 g. | 836 g. | 822 g. |
| Weight after pressing | 267 g. | 243 g. | 236 g. |
| % NaOH retained with respect to dry bagasse | I7,3 | I5,4 | I5,I |
| Cooking Temperature | I70° | I70° | I70° |
| Time | 30' | 30' | 30' |
| Overall yield | 38,8 | 4I | 43,5 |
| % uncooked | 0,8 | 0,7 | 0,8 |
| Net Yield | 38 | 40,3 | 42,7 |
| permanganate index | 5,5 | I0,2 | I2,5 |
| photovolt whiteness | 47 | 44 | 43 |
| Physical properties of the obtained paper | | | |
| Time of refining treatment | 6 | 6' | 6' |
| Weight by square meter | 62 | 62 | 62 |
| Break index | 2,95 | 3,8 | 4,2 |
| Length of the breach | 4570 | 6800 | 7500 |
| Stretch at drawing | 2,I | 2,3 | 2,45 |

We claim:

1. A process for the pulping of a raw lignocellulosic material which consists essentially of the steps of impregnating said raw lignocellulosic material in finely divided form at atmospheric pressure with an impregnating solution whose constituents consist essentially of water, 2 to 20% by weight of alkali metal hydroxide, alkali metal salt, alkaline earth metal hydroxide or alkaline earth metal salt and 2 to 20% by weight of a solvent having a boiling point above 150° C. selected from the group consisting of diols, alkanolamines and sulfoxides, said impregnating being effected at a temperature of 80° to 100° C. using a quantity of impregnating solution such the amount of said alkali metal hydroxide or salt or alkaline earth metal hydroxide or salt retained by said lignocellulosic material is 11 to 29% of the dry weight of said material, and the amount of said solvent retained is sufficient to lower the melting point of said alkali metal hydroxide, alkali metal salt, alkaline earth metal hydroxide or alkaline earth metal salt in the said impregnated mass to between 150° and 200° C., removing unabsorbed impregnating solution from the impregnated mass and adjusting the weight of the retained impregnating solution so that the ratio of the weight of said impregnated mass to the dry weight of said lignocellulosic material is not more than about 2.6:1, cooking a material consisting of the resulting adjusted impregnated solid mass at a temperature from 150° and 200° C. for 15 to 60 minutes in an exclusively externally heated closed reactor without exerting any mechanical disintegration action on the mass, and pressing the cooked product so as to extract therefrom the solubilized lignin in the form of a black liquor containing about 50% dry material.

2. Process according to claim 1 wherein said cooking is effected at a pressure of 3 to 8 bars.

3. Process according to claim 1 in which the steps of removing unabsorbed impregnating solution and adjusting the weight of the retained impregnating solution before the cooking step are effected by draining said unabsorbed solution and drying the impregnated lignocellulosic material in a tunnel oven.

4. Process according to claim 1 wherein a quantity of water is added to the cooked material in an amount such that the subsequent pressing yields said a black liquor containing about 50% dry material.

5. A process according to claim 1, wherein the amount of said solvent retained is sufficient to lower the melting point of said alkali metal compound or alkaline earth metal compound in said impregnated mass to between 150° and 180° C.

* * * * *